US005451142A

United States Patent [19]

Cetel et al.

[11] Patent Number: 5,451,142

[45] Date of Patent: Sep. 19, 1995

[54] TURBINE ENGINE BLADE HAVING A ZONE OF FINE GRAINS OF A HIGH STRENGTH COMPOSITION AT THE BLADE ROOT SURFACE

[75] Inventors: Alan Cetel, West Hartford; Dinesh K. Gupta, Vernon, both of Conn.

[73] Assignee: United Technologies Corporation, Hartford, Conn.

[21] Appl. No.: 219,559

[22] Filed: Mar. 29, 1994

[51] Int. Cl.[6] ..... F01D 5/28

[52] U.S. Cl. ..... 416/241 R; 415/200

[58] Field of Search ..... 416/241 R; 415/200; 428/328

[56] References Cited

U.S. PATENT DOCUMENTS

| | | | |
|---|---|---|---|
| 3,342,455 | 9/1967 | Fleck et al. | 253/77 |
| 3,494,709 | 2/1970 | Piearcey | 416/232 |
| 3,761,201 | 9/1973 | Silverstein | 416/232 |
| 3,790,303 | 2/1974 | Endres | 416/241 |
| 4,008,052 | 2/1977 | Vishnevsky et al. | 29/194 |
| 4,168,183 | 9/1979 | Greenfield et al. | 148/4 |
| 4,195,683 | 4/1980 | Blazek | 164/10 |
| 4,246,323 | 1/1981 | Bornstein et al. | 428/678 |
| 4,279,575 | 7/1981 | Avery et al. | 416/244 |
| 4,494,287 | 1/1985 | Cruzen | 29/156 |
| 4,582,548 | 4/1986 | Harris et al. | 148/404 |
| 4,592,120 | 6/1986 | Egan | 29/156 |
| 4,744,725 | 5/1988 | Matarese et al. | 415/173.4 |
| 4,921,405 | 5/1990 | Wilson | 416/241 R |
| 5,106,266 | 4/1992 | Borns et al. | 416/241 |
| 5,113,583 | 5/1992 | Jenkel et al. | 29/889 |
| 5,271,976 | 12/1993 | Kondo et al. | 428/328 |

FOREIGN PATENT DOCUMENTS

| | | |
|---|---|---|
| 0246082 | 11/1987 | European Pat. Off. . |
| 60-212603 | 10/1985 | Japan . |

*Primary Examiner*—John T. Kwon

[57] ABSTRACT

Blades for use in modern gas turbine engines are described and are characterized by a thin zone of fine grains of a high strength composition on the surface of the blade root.

1 Claim, 3 Drawing Sheets fig. 1
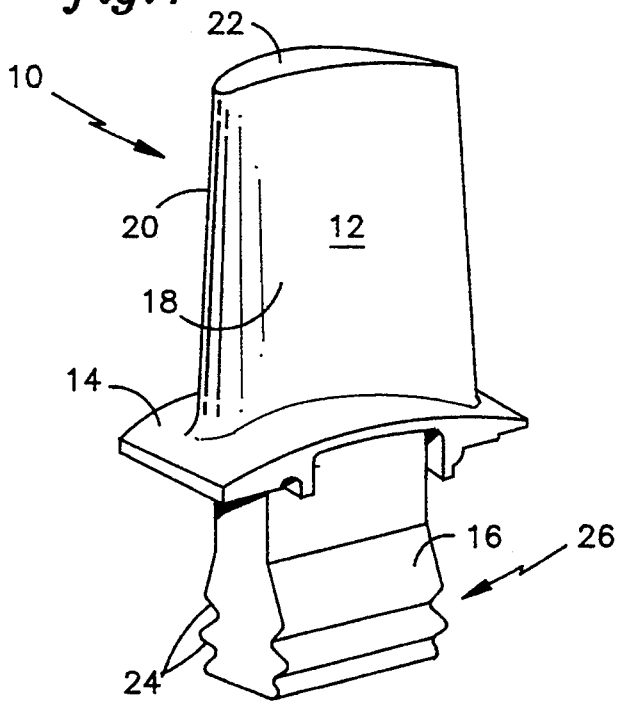
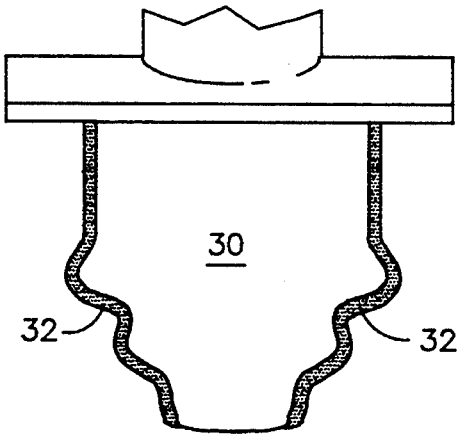
fig. 2
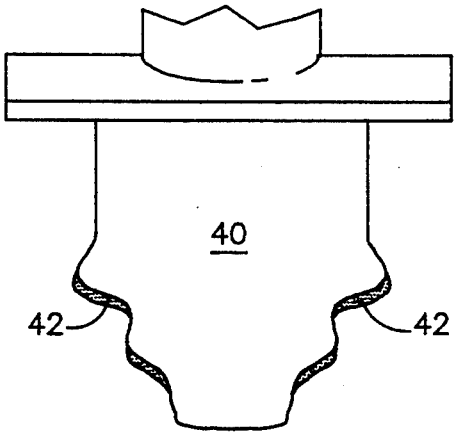
fig. 3

TURBINE ENGINE BLADE HAVING A ZONE OF FINE GRAINS OF A HIGH STRENGTH COMPOSITION AT THE BLADE ROOT SURFACE

TECHNICAL FIELD

This invention relates to gas turbine engines, and to blades used in gas turbine engines. In particular, the invention relates to gas turbine engine blades having improved fatigue strength.

BACKGROUND ART

Metal castings, having either an equiaxed, columnar grain, or single crystal microstructure, are widely used in the turbine section of modem gas turbine engines. Frequently, these castings are used as turbine blades, and they are subjected to some of the most severe operating conditions of all parts used in the engine. Because of the demands placed upon these parts, and the critical nature they play in the overall performance of the engine, the parts are fabricated from alloys called superalloys, which have an optimum balance of mechanical strength and resistance to oxidation and hot corrosion. The mechanical strength characteristics which are required of turbine section components include creep strength and resistance to thermal fatigue.

Turbine blades have an airfoil portion and a root portion; typically, the root portion has a fir-tree design. The blades are assembled to a turbine disk which has slots appropriately machined to allow the root portion of the blade to slide into the slot. A variety of designs are utilized to prevent the blade from sliding out of the disk slot during operation of the engine.

As indicated above, the airfoil portion of the blade is exposed to the most rigorous combination of temperature and stress conditions during engine operation; creep strength is a major design requirement for the airfoil portion of the blade. Insufficient creep strength can cause catastrophic failure during use in the engine.

While somewhat shielded from the elements during engine operation, the root portion of the blade also experiences a combination of stress and elevated temperature conditions that can cause cracking in the attachment area of the blade root. These cracks can also cause the blade to fail. The stresses that result in crack formation are primarily associated with low and high cycle fatigue. Attachment strength is a major design requirement of the root portion of the blade.

The engineering difficulties of achieving an optimum combination of high temperature creep strength and lower temperature attachment properties in a turbine blade are well known to those skilled in the art. The difficulties exist because alloy compositions and casting processes that are well adapted for producing desirable levels of creep strength for the airfoil portion of the part do not usually produce desirable attachment properties for the root portion of the part. In particular, the compositions and fine grain sizes that are required for superior attachment strength produce components that have marginal creep strength; conversely, the compositions and casting processes that are required for superior creep strength produce pans that have marginal attachment properties for advanced high stress applications.

One way that the attachment strength of cast blades made of creep resistant materials can be improved is by peening the root with either glass or steel shot. The peened blade root has better resistance to the formation of fatigue cracks than the unpeened blade root, because peening forms residual compressive stresses at the surface of the root, providing it with better resistance to crack initiation. However, as engineers attempt to design engines with increased thrust and performance capabilities, the temperatures in the turbine section become higher; if these are sufficiently high, they can accelerate the rate at which the compressive stresses (due to peening) are annealed from the blade root. Furthermore, to achieve and improve performance, engineers increase rotors speeds, which raise stress levels in the root and reduce blade root attachment life.

Another way that engineers have tried to improve the attachment strength of blades made of creep resistant materials is the bi-cast process. In the first step of this process, the airfoil portion of a turbine blade is fabricated from an alloy in such a manner to optimize creep strength. Then, molten metal of a different composition is cast around the airfoil portion in such a manner to produce a finer grained root structure having better attachment properties. See, e.g., U.S. Pat. No. 4,008,052. Bi-cast components have, unfortunately, not achieved commercial success due to the inability of the process to produce a high-integrity bond joint between the airfoil and root portions. In particular, it is very difficult to control the cleanliness of the interface between the airfoil and root portions, and to control the complicated melting and solidification processes at that interface. It is also very difficult to inspect the quality of the interface itself. Finally, the casting processes are unable to produce grain sizes in the root area that are truly free enough for optimum attachment properties; grain sizes are generally no smaller than 250–625 microns (10–25 mils).

A variation of the bi-cast process involves diffusion bonding separately fabricated airfoil and root portions to each other, as shown in U.S. Pat. No. 4,592,120. This patent describes a method for diffusion bonding an airfoil portion fabricated from a single crystal alloy having desirable creep strength, such as CMSX2, to a root portion fabricated from a powder metal disk alloy having desirable attachment strength, such as Astroloy. The two components are bonded together using a boron-enriched bonding alloy and a bonding temperature of 1,205° C. (2,200° F.). Like the aforementioned bi-cast process, the diffusion bonding process has not achieved widespread commercial success for many of the same reasons recited above. A further deficiency of the diffusion bonding process is that the elevated bonding temperatures can cause grain growth of the fine Astroloy grains, thereby decreasing the attachment strength of the root. The process also introduces a potentially undesirable element, in this case, boron, into the casting.

As a result of the inadequacies of these prior art processes, the gas turbine engine industry continues to search for ways to improve the fatigue strength of the turbine blade root while retaining optimum creep strength in the airfoil.

SUMMARY OF THE INVENTION

According to this invention, a blade for the turbine section of a gas turbine engine is characterized by a thin zone of fine grains at the surface of the blade root, each grain having an average size of about 5 microns (0.2 mils) or less; the grains in said zone have a high strength composition different from the composition of the remainder of the blade, and are comprised of $\gamma'$ phase particles in a $\gamma$ phase matrix.

The presence of the thin zone of fine grains of a high strength composition at the blade root surface produces a component that has excellent attachment strength, i.e., excellent resistance to the initiation of fatigue cracks during use of the part in a modem turbine engine. At the same time, the blade has superior creep strength at the airfoil portion of the blade, because that portion of the blade is fabricated using the compositions and processes that optimize creep strength. The thickness of the zone of grains is no greater than about 1,250 microns (50 mils).

Further features and advantages of the present invention will be appreciated by referring to the drawings, as briefly described below, and the best mode for carrying out the invention.

BRIEF DESCRIPTION OF THE DRAWINGS

FIG. 1 is a perspective view of a turbine blade for a gas turbine engine;

FIGS. 2 and 3 are schematic views showing alternate embodiments of the invention;

BEST MODE FOR CARRYING OUT THE INVENTION

Figure 4:
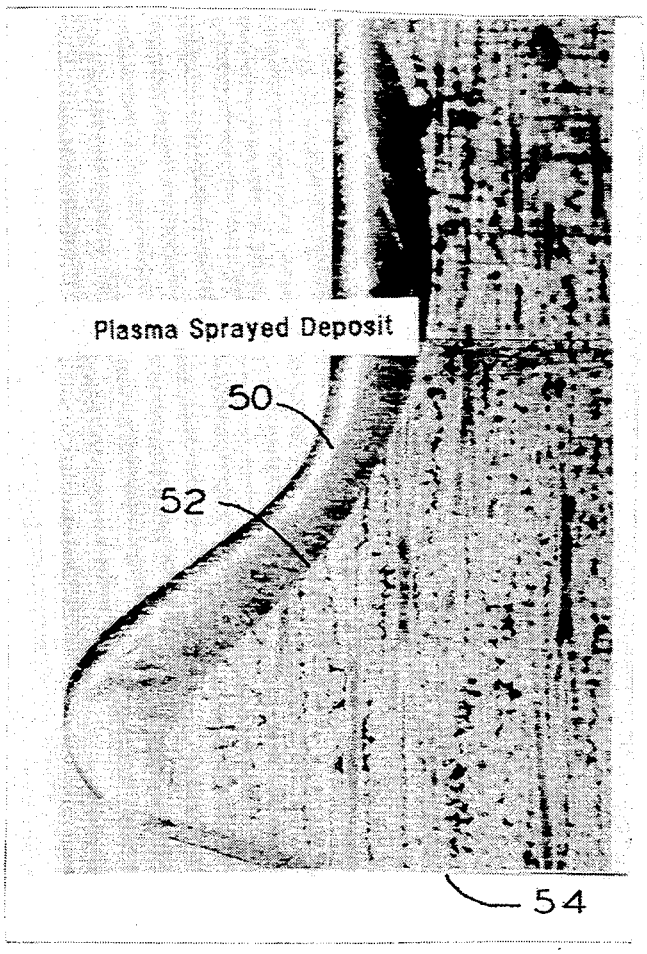
FIG. 4 is a photomicrograph showing the root portion of a blade in accordance with the invention.

FIG. 1 shows a perspective view of a turbine blade 10 for a modem gas turbine engine. The blade includes an airfoil portion 12, a platform 14, and a root portion 16. The airfoil portion 12 has a pressure side 18 and a suction side 20, and an airfoil tip 22. The platform 14 extends about the periphery of the blade and generally separates the airfoil portion 12 from the root portion 16. The root portion 16 has a fir-tree shape. The fir-tree shape is widely used in the turbine industry to provide an effective means for attaching the blade to a turbine disk, which includes slots appropriately machined to accept each blade root. Assembly of the blade to the disk is performed by sliding the root 16 of the blade 10 in the axial direction into its respective disk slot. During operation of the engine, the disk rotates about its axis, and the radially inwardly facing lobes 24 on the fir-tree 26 contact their counterpart surfaces of the disk as each blade 10 moves in the radially outward direction due to centrifugal forces. The fir-tree shape is particularly well suited to secure the blade 10 to the disk and it is the preferred design in the gas turbine engine industry. It should be recognized, however, that alternate blade root and disk slot designs are used, and are within the scope of the present invention.

Turbine blade compositions and methods for making them are well known in the art. See, for example, the equiaxed grain structures of U.S. Pat. No. 4,905,752; the single crystal turbine blades of, e.g., commonly assigned U.S. Pat. No. 4,209,348 to Duhl et al; and the columnar grain castings of, e.g., commonly assigned U.S. Pat. No. 5,068,084 to Cetel et al. Castings made from the superalloy compositions described in the aforementioned patents are known for their excellent properties, especially their creep strength and resistance to oxidation and corrosion. They are also known to have, in general, adequate low cycle fatigue strength. These compositions are set forth below, in Table I.

TABLE I

Alloy Compositions For Turbine Blade Applications
Nominal composition of exemplary blades, by weight percent

| Microstructure Type | Cr | Co | C | Ti | Al | Mo | W | B | Hf | Ta | Zr | Y | Cb | Re | Ni |
|---|---|---|---|---|---|---|---|---|---|---|---|---|---|---|---|
| Equiazed | 8 | 10 | 0.1 | 1 | 6 | 6 | 0 | 0.015 | 1.15 | 4.25 | 0.08 | 0 | 0 | 0 | Balance |
| Columnar Grain | 9 | 10 | 0.14 | 2 | 5 | 0 | 12.5 | 0.015 | 1.6 | 0 | 0 | 0 | 1 | 0 | Balance |
| Single Crystal | 10 | 5 | 0 | 1.5 | 5 | 0 | 4 | 0 | 0 | 12 | 0 | 0 | 0 | 0 | Balance |
| Range | 4–11 | 4–13 | 0–0.2 | 0–5 | 4–7 | 0–7 | 0–13 | 0–0.02 | 0–2 | 0–13 | 0–0.1 | 0–0.02 | 0–2 | 0–4 | Balance |

Another class of alloys are known for their excellent attachment strengths and resistance to low cycle fatigue at the low to intermediate temperature conditions (i.e., up to about 760° C. (1,400° F.)) that turbine disks operate at. Many of these alloys were specifically designed to fabricate turbine disks; the disks are made by powder metallurgy processes, or by forging processes. Examples of these alloys are known by the trade names IN100, MERL 76, Waspaloy, Rene 95 and Udimet 720. Disks made from these materials owe their desirable attachment strengths and other properties to their alloy composition and to their ability to be fabricated into components having the combination of a free grain size and a fine distribution of $\gamma'$ particles within a $\gamma$ phase matrix. The compositions of these types of alloy are shown in Table II below:

TABLE II

Alloy Compositions Having Excellent Attachment Strength
Nominal composition, by weight percent

| Alloy Name | Al | B | C | Co | Cr | Hf | Mo | Cb | Ta | Ti | V | W | Zr | Ni |
|---|---|---|---|---|---|---|---|---|---|---|---|---|---|---|
| IN100 | 5.0 | 0.02 | 0.07 | 18.5 | 12.4 | 0 | 3.2 | 0 | 0 | 4.33 | 0.78 | 0 | 0.06 | Balance |
| MERL 76 | 5.0 | 0.02 | 0.025 | 18.25 | 12.2 | 0.4 | 3.2 | 1.35 | 0 | 4.33 | 0 | 0 | 0.06 | Balance |
| AF115 | 3.8 | 0.02 | 0.05 | 15.0 | 10.5 | 0.75 | 2.8 | 1.8 | 0 | 3.9 | 0 | 5.9 | 0.05 | Balance |
| AF2-1DA | 4.5 | 0.015 | 0.325 | 10.0 | 12.0 | 0 | 3.0 | 0 | 1.5 | 3.0 | 0 | 6.0 | 0.10 | Balance |
| Astrology | 4.0 | 0.025 | 0.096 | 17.0 | 15.0 | 0 | 5.0 | 0 | 0 | 3.5 | 0 | 0 | 0 | Balance |
| CH-88 | 3.5 | 0.03 | 0.03 | 15.0 | 10.0 | 0 | 5.0 | 0 | 7.2 | 3.0 | 0 | 5.0 | 0.03 | Balance |
| N18 | 4.5 | 0.02 | 0.02 | 12.5 | 12.0 | 0.5 | 7.0 | 0 | 0 | 4.5 | 0 | 0 | 0 | Balance |
| Rene '95 | 3.5 | 0.01 | 0.065 | 8.0 | 13.0 | 0 | 3.5 | 3.5 | 0 | 2.5 | 0 | 3.5 | 0.05 | Balance |
| Udimet 720 | 2.5 | 0.033 | 0.035 | 14.5 | 18.0 | 0 | 3.0 | 0 | 0 | 5.0 | 0 | 1.25 | 0.03 | Balance |
| Waspaloy | 1.4 | 0.007 | 0.06 | 13.5 | 19.5 | 0 | 4.25 | 0 | 0 | 3.0 | 0 | 0 | 0.07 | Balance |
| Rene '95 | 2.2 | 0.01 | 0.05 | 12.7 | 16.0 | 0 | 4.2 | 0.7 | 0 | 3.9 | 0 | 3.9 | 0.05 | Balance |
| Range | 1–6 | 0.005–0.04 | 0.01–0.10 | 7–20 | 9–21 | 0–1 | 0–8 | 0–4 | 0–8 | 2–6 | 0–1 | 0–7 | 0–0.2 | Balance |

While the superalloy compositions in Table II above have found widespread use as disk materials, they are not used as blades, vanes, or other turbine section parts. This is because these alloys have insufficient creep strength above 760° C. (1,400° F.) to endure the high airfoil temperatures of blades and vanes. However, below about 760° C., the low cycle fatigue life (a typical measure of root attachment strength) of the aforementioned disk materials is about 10 to 30 times better than that of blade and vane materials.

According to this invention, turbine engine blades having dramatically improved attachment strength include a cast airfoil and root portion of a high creep strength alloy, wherein the root portion also includes a relatively thin zone of fine grains at the surface of the root; the composition of the fine gains in the zone of grains at the root surface is of an alloy having high attachment strength. Each of the fine gains at the root surface has an average size of about 5 microns (0.2 mils) or less. Additionally, the gains in the zone of fine gains are strengthened by $\gamma'$ phase particles in a $\gamma$ phase matrix. Finally, the zone of fine gains is dense, with porosity minimized. The gains have a cast microstructure, as opposed to a powder metallurgy or wrought structure. The thickness of the zone of gains is dictated by the magnitude of the stresses in the blade root attachment area during engine operation; in the locations that stresses exceed the strength capability of the casting, the zone of free gains is in the range of about 250 to 1,250 microns (10 to 50 mils) thick. The composition of the gains is within the range of compositions recited in Table II above. In the preferred embodiment of the invention, the zone of free gains is applied by a low pressure plasma spray process.

As is known to those skilled in the art, the casting processes used to make turbine engine blades produce a microstructure that is characterized by, either, a plurality of equiaxed gains, a plurality of columnar gains, or a single gain. The gain structure in each of these types of castings is relatively constant from the blade tip to the blade root; in other words, and for example, a blade having an equiaxed structure is characterized by equiaxed gains that extend from the blade tip to the blade root. Similarly, a blade having an columnar gain structure comprises a plurality of columnar gains that extend, in general, from the blade tip to the blade root. And finally, a blade having a single crystal structure comprises a singular gain that extends from the blade tip to the blade root. (It should be noted, however, that some blades that are referred to as "single crystals" may have, in fact, a few gains with small orientation deviations scattered through its structure. Such blades are nonetheless considered to be single crystals if they are predominantly a single crystal.)

The present invention is applicable to turbine blades having either an equiaxed, columnar grain or single crystal cast microstructure. In equiaxed castings, the average size of each cast grain is greater than or equal to about 625 microns (about 25 mils). While a precise measurement of grain size in columnar grain and single crystal castings can be somewhat imprecise and difficult to accomplish because of their shape, such grains are considerably larger than those in equiaxed castings. By comparison, the grains that make up the zone of fine grains at the blade root according to this invention is considerably smaller than such equiaxed cast grains by a least one order of magnitude, and typically smaller by two orders of magnitude.

The zone of fine, $\gamma/\gamma'$ strengthened grains at the surface of the root according to this invention can extend along the entire periphery of the root surface, as indicated in FIG. 2, or it can be present on less than the entire periphery of the root, as indicated in FIG. 3. In FIG. 2, the root and zone of grains are indicated by the reference numerals 30 and 32, respectively. In FIG. 3, the root and zone of grains are indicated by the reference numerals 40 and 42, respectively. As indicated above, the thickness of the zone is determined by the highest stresses that the root attachment area experiences during engine operation. One way these stresses can be determined is by finite element analysis, although other methods are known to those skilled in the art. Typically, the thickness of the zone will be within the range of about 250 microns to about 1,250 microns (about 10 to 50 mils).

Several techniques are contemplated for making blades in accordance with the invention. Plasma spray techniques are the preferred method for carrying out the invention; methods for depositing material according to the plasma spray process are well known. The term "plasma spray" is meant to include processes such as flame spraying, plasma are spraying, low pressure plasma spraying, inert gas shielded plasma spraying, high velocity oxygen free spraying, and other similar such process. Low pressure plasma spray processes are the most preferred process for carrying out the invention. In summary, the plasma spray process transports a stream of metallic particles through a high temperature flame or plasma, which heats and softens the particles and propels them onto a surface, where they impact and solidify. The particles solidify on the part surface in a rapid solidification process which produces a cast microstructure.

FIG. 4 is a photomicrograph showing the root attachment area of a turbine blade in accordance with the present invention. The Figure shows the zone of fine grains 50 at the surface 52 of the root 54. The high density of the grains within the zone is readily apparent. The grains include $\gamma'$ particles within a $\gamma$ phase matrix; the $\gamma'$ particles have a very free size themselves, typically less than about 0.4 microns (about 0.016 mils). In FIG. 4, the thickness of the zone of fine grains is approximately 625 microns, and the composition of the grains is IN100, as described in more detail below.

The following examples demonstrate additional features and advantages of the present invention. Two nickel base superalloys having high creep strength in single crystal cast form were utilized to evaluate the invention. One superalloy, known as PWA1480, had the composition recited above; the other superalloy was an experimental, third generation superalloy based partially on PWA1480. To evaluate the low cycle fatigue properties of these materials when used in accordance with the present invention, single tooth fir-tree specimens of the type well known in the an were machined from single crystal cast bars. The fir-tree specimens included a threaded, grip portion for assembly into a conventional low cycle fatigue test rig, and a shaft portion terminating in a end portion characterized by a single tooth extending radially outwardly from the axis of the specimen. Each specimen was machined to an undersized configuration in the tooth portion of the specimen, to accommodate the ultimate presence of a 500 micron (20 mil) thick zone of fine $\gamma'$ strengthened grains on the surface of the root, as described in more detail below.

The fir-tree portion of each specimen was plasma sprayed with powder particles of a nickel base alloy having high attachment strength, the alloy composition falling within the range of compositions recited in Table II above; just prior to the powder application process, the surface of the specimens were cleaned of surface contaminants. After the powder application, the specimens were hot isostatically pressed (HIP'd) in order to achieve full density within the sprayed layer; they were then heat treated to optimize the properties of the layer and the single crystal substrate; finally the specimens were machined to achieve a desired thickness of material in the high strength toothed portion of each specimen.

More particularly, the specimens were prepared by plasma spraying approximately 875 to 1,250 microns (35 to 50 mils) of the nickel base superalloy known as IN100 onto the toothed portion of each specimen; the composition of the IN100 is set forth above; its mesh size was −400 mesh. The IN100 powder was applied by a conventional low pressure plasma spray process in which oxygen was essentially excluded from the spray environment to preclude the formation of oxides within the deposited material. Prior to the actual spray application of the powder particles, and while the specimens were still within the spray chamber, the surface of each specimen was cleaned by a reverse transfer are process. Immediately on completion of the cleaning step, the spray process started. This sequence assured that the interface between the substrate and the zone of fine grains was clean and free of contaminants. As indicated above, parts made with the prior art bi-cast and diffusion bonding processes suffer from the presence of oxide contamination at the surface of the substrate. According to this preferred embodiment, the casting surface is cleaned in the same chamber that the zone of fine grains is applied, such that contamination of the substrate surface is prevented. After the plasma spray operation, complete closure of porosity within the sprayed deposit was achieved by hot isostatic pressing at 1,095° C. (2,000° F.) for 4 hours at $1\times10^2$ MPa (15 ksi) pressure. Other hot isostatic press parameters may also be useful, depending on the composition of the substrate and the grains in the zone of free grains; for the compositions recited above, the minimum HIP temperature, time and pressure should be 1,065° C. (1,950° F.), 4 hours and $1\times10^2$ MPa (15 ksi), respectively. The maximum HIP temperature should be below the $\gamma'$ solvus temperature of the fine grain zone, so that the size of the fine grains is unaffected by the HIP process.

After the HIP process, the samples were solution heat treated at 1,080° C. (1,975° F.) for 2 hours, followed by a 40° C. (70° F.) per minute cooling rate; this was followed by a 730° C. (1,350° F.) aging treatment for 8 hours. Other heat treatment schedules are likely useful and dependent upon the composition of the substrate and the grains in the zone of fine grains, but should stay below the $\gamma'$ solvus temperature. Finally, the samples were machined to achieve the desired thickness of the zone of five grains, and to achieve a smooth surface.

Metallographic examination of the HIP and heat treated specimens showed that the zone of fine grains at the surface of each specimen was characterized by a dense array of generally equiaxed grains, and was characterized by a free, uniform distribution of $\gamma'$ particles within a $\gamma$ phase matrix. The interface between the zone of fine grains and the substrate was free of contamination. The zone was characterized by ultra fine grains, ASTM 12 (calculated diameter of average grains, 5 microns) or smaller.

Figure 5:
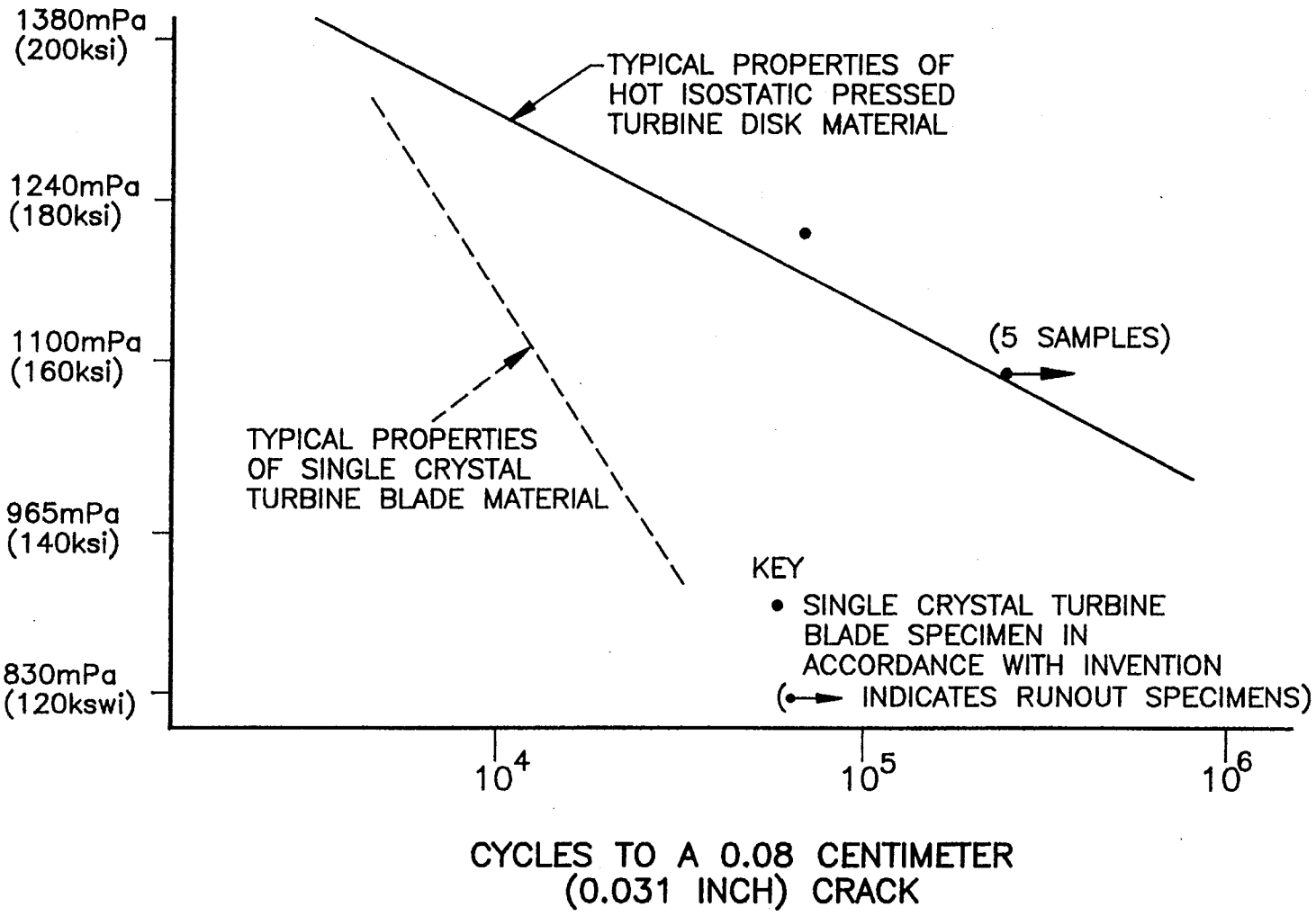
FIG. 5 is a graph showing the improvement in fatigue life of parts in accordance with the invention.

Low cycle fatigue tests were conducted at a test temperature of 590° C. (1,100° F.), which is a typical root attachment temperature for modem gas turbine engines. As shown in FIG. 5, the specimens treated in accordance with this invention had strength levels that approached the strength of modem turbine disk materials. In particular, the single crystal fir-tree specimens showed a nearly 10 times improvement in low cycle fatigue life when they included a zone of fine grains of a high attachment strength alloy at the load bearing surface of the specimen.

Examination of the fracture surfaces of the tested specimens revealed that fracture initiated near the outer surface of each specimen, since this is the high stress location on the component. It eventually progressed through the zone of high strength grains and into the single crystal superalloy substrate. No material abnormalities were evident at the fatigue initiation sites, and no secondary cracking along the substrate-deposit interface were observed.

The data generated and described above established that significant benefits could be achieved through the use of this invention. While these tests were conducted on $\gamma/\gamma'$ strengthened single crystal nickel base superalloy substrates, it should be understood by those skilled in the art that the invention is not so limited. Rather, the invention is suitable for any of the known single crystal, columnar grain or equiaxed alloys used in the gas turbine engine industry for turbine airfoil components. The composition range of this class of castings is listed in Table I above.

In the preferred embodiment of the invention, new parts are fabricated to incorporate the invention before they are placed into service. According to an alternative embodiment of the invention, parts which have already been used are treated to improve their fatigue strength. In this embodiment, the blades are removed from service and submitted to a machining operation that removes material from the high stress portion of the blade root surface. The material that is machined from the root is, after cleaning the substrate by a process which removes all surface contaminants, replaced by the zone of fine grains of a high strength composition as described above. The part is then processed through a hot isostatic press cycle to densify the deposit, and a heat treatment cycle to enhance properties. Finally, the root is machined back to the desired blueprint dimensions, and the part returned to service.

Although this invention has been shown and described with respect to detailed embodiments thereof, it should be understood by those skilled in the art that various changes in form and thereof may be made without departing from the spirit and scope of the claimed invention.

We claim:

1. A turbine engine blade comprising an airfoil portion and a root portion, wherein the root portion includes a zone of grains at the root surface, each grain having an average size of about 5 microns or less, wherein the grains in said zone have a high strength composition different from the composition of the remainder of the blade, and are comprised of $\gamma'$ phase particles in a $\gamma$ phase matrix, and wherein the zone of grains is between 250 and 1,250 microns thick, and wherein the composition of said blade comprises 4–11 Cr, 4–13 Co, 0–0.2 C, 0–5 Ti, 4–7 Al, 0–7 Mo, 0–13 W, 0–0.02 B, 0–2 Hf, 0–13 Ta, 0–0.1 Zr, 0–0.02 Y, 0–2 Cb, 0–4 Re, balance Ni, and the composition of the grains in the zone of grains comprises 1–6 Al, 0.005–0.04 B, 0.01–0.10 C, 7–20 Co, 9–21 Cr, 0–1 Hf, 0–8 Mo, 0–4 Cb, 0–8 Ta, 2–6 Ti, 0–1 V, 0–7 W, 0–0.2 Zr, balance Ni.

* * * * *